United States Patent [19]

Cunningham

[11] 3,993,355

[45] Nov. 23, 1976

[54] MINING MACHINE HAVING PNEUMATIC CONVEYANCE AND CUTTER HEAD FLOOR DRIVEN ABOUT ANCHOR

[76] Inventor: Kelly G. Cunningham, 600 Goff Mountain Road, Nitro, W. Va. 25143

[22] Filed: Nov. 17, 1975

[21] Appl. No.: 632,600

[52] U.S. Cl. ..... 299/31; 299/18; 299/56; 299/67; 173/60; 175/100

[51] Int. Cl.[2] ..... E21C 35/20

[58] Field of Search ..... 299/18, 31, 64–68, 299/56, 57; 175/100; 173/60; 37/64–67

[56] References Cited

UNITED STATES PATENTS

| | | | |
|---|---|---|---|
| 3,169,796 | 2/1965 | Long et al. | 299/64 X |
| 3,673,716 | 7/1972 | Trondle | 37/67 X |
| 3,726,562 | 4/1973 | Wharton | 299/18 X |
| 3,843,198 | 10/1974 | Reynolds | 173/60 X |

*Primary Examiner*—Ernest R. Purser
*Attorney, Agent, or Firm*—Sughrue, Rothwell, Mion, Zinn and Macpeak

[57] ABSTRACT

A mining system for extraction of coal or the like from narrow seams has a conduit system for pneumatic conveyance of mined material. A leading section of apparatus comprises a cutter head assembly driven by an air motor which exhausts into the conduit system. The leading section includes further an anchoring means which is changeably mounted thereon to permit advance of the leading section and cutter head assembly, and ground contact means for pivoting of the cutter head from side-to-side.

9 Claims, 17 Drawing Figures

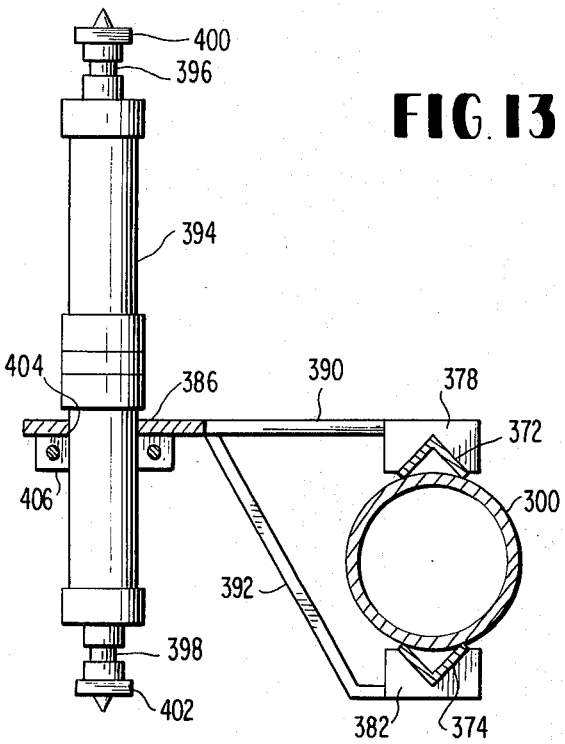
FIG. 13
FIG. 10
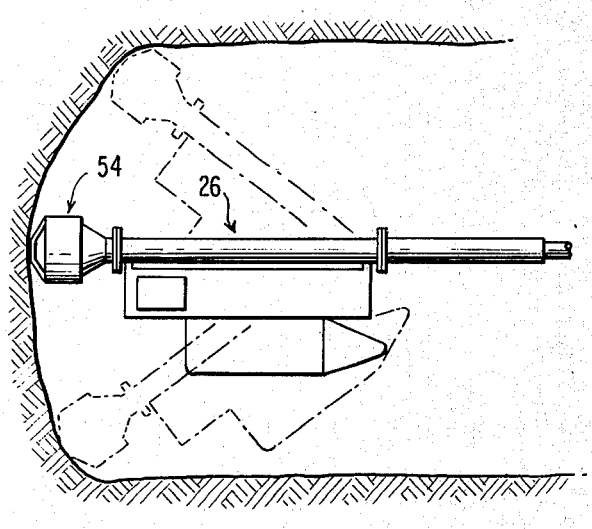
FIG. 14
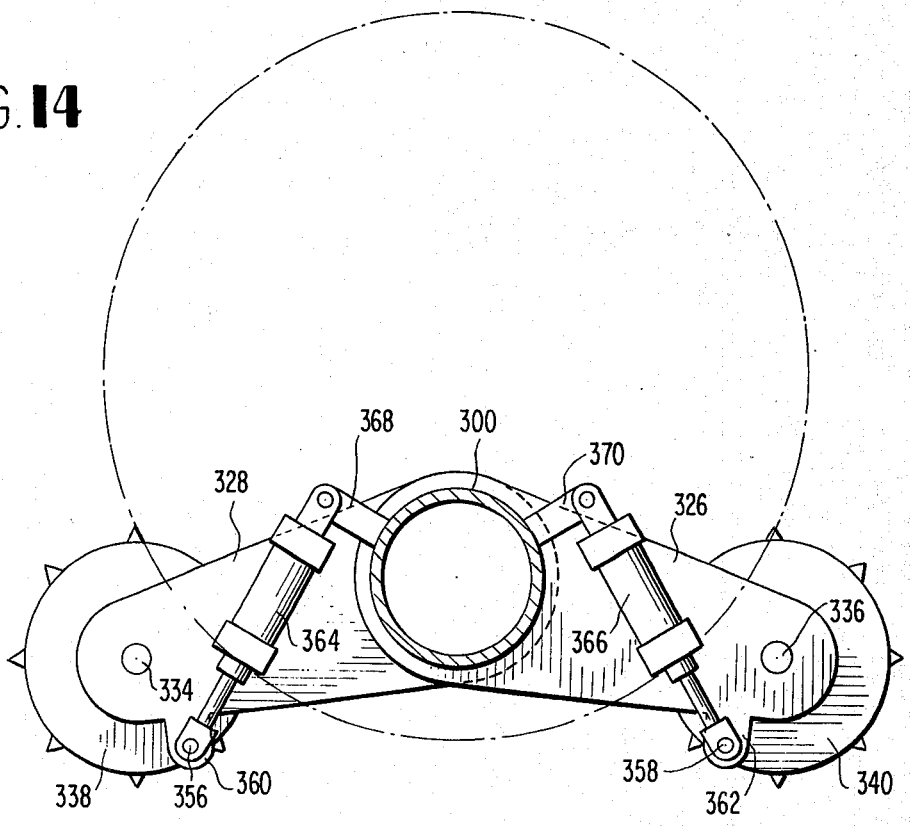

454
456
314'
424'
310'
438
433
364'
342'
322'
300'
334'
352'
330'
350'
354'
344'
346'
340'
368'
370'
326'
336'
356'
436
358'
366'
302'
308'
447
324'
434
442
440
448
446
435
452
450

MINING MACHINE HAVING PNEUMATIC CONVEYANCE AND CUTTER HEAD FLOOR DRIVEN ABOUT ANCHOR

BACKGROUND OF THE INVENTION

1. Field of the Invention

This invention pertains to mining apparatus, and particularly to apparatus employed in extracting coal and the like from narrow seams.

2. Statement of the Prior Art

Pneumatic conveyance of mined materials has been heretofore proposed. Examples in patents known to applicant of such prior proposals include the following:

| Patent No. | Patentee | Issued |
|---|---|---|
| 1,194,298 | Kuhn | Aug. 8, 1916 |
| 2,100,178 | White | Nov. 23, 1937 |
| 2,375,689 | Reeder | May 8, 1945 |
| 3,005,627 | Tinlin | Oct. 24, 1961 |
| 3,225,678 | Densmore | Dec. 28, 1965 |
| 3,260,548 | Reichl | July 12, 1966 |
| 3,305,268 | Todd | Feb. 21, 1967 |
| 3,362,752 | Densmore | Jan. 9, 1968 |
| 3,368,848 | Hughes | Feb. 13, 1968 |
| 3,387,889 | Ziemba et al. | June 11, 1968 |
| 3,533,660 | Russell | Oct. 13, 1970 |
| 3,574,405 | Shimada et al. | Apl. 13, 1971 |
| 3,795,304 | Poundstone | Mar. 5, 1974 |
| Re 24,004 | Howard | Reissued: May 17, 1955 |

SUMMARY OF THE INVENTION

Mining operations in recent years have often employed a technique commonly known as strip mixing. Where that technique is practiced, a seam of coal located near the surface is exposed by removal of the covering layer of earth, and thereafter mined by simple excavation. This procedure must of necessity be terminated when the coal seam extends to a depth below that which may be reasonably uncovered at a commercially feasible cost. This results often in the loss of substantial amounts of desirable coal. Conventional tunneling procedures are too costly and time consuming to be practical for recovery of these narrow seams of coal. The present invention is directed to a mobile, self-contained system for mining of shallow seams of coal, being particularly suited to employment in those instances where the seam has been initially strip mined and thereafter has descended to a depth where continued strip mining is impractical.

The system hereof provides a means for pneumatic cutting and conveyance of material to be mined. The pneumatic source used to power the cutter head assembly also effectively functions to assist in conveyance of the mined material. The cutter head reduces the mined coal fragements to a size adapted for pneumatic conveyance, and the intake functions in venturi fashion to exhaust the coal.

The invention is powered exclusively by air motor, and therefore provides a substantial safety factor in avoiding electrical spark factors within the mining shaft.

Other and further objects and advantages of the invention will become apparent to those skilled in the art from a consideration of the following specification when read in conjunction with the annexed drawings.

BRIEF DESCRIPTION OF THE DRAWINGS

FIG. 10 is a schematic top view showing the mining operation;

FIG. 13 is a sectional view on line 13 — 13 of FIG. 11, looking in the direction of the arrows;

FIG. 14 is a sectional view showing details on line 14 — 14 of FIG. 11.

DESCRIPTION OF THE PREFERRED EMBODIMENT

Figure 1:
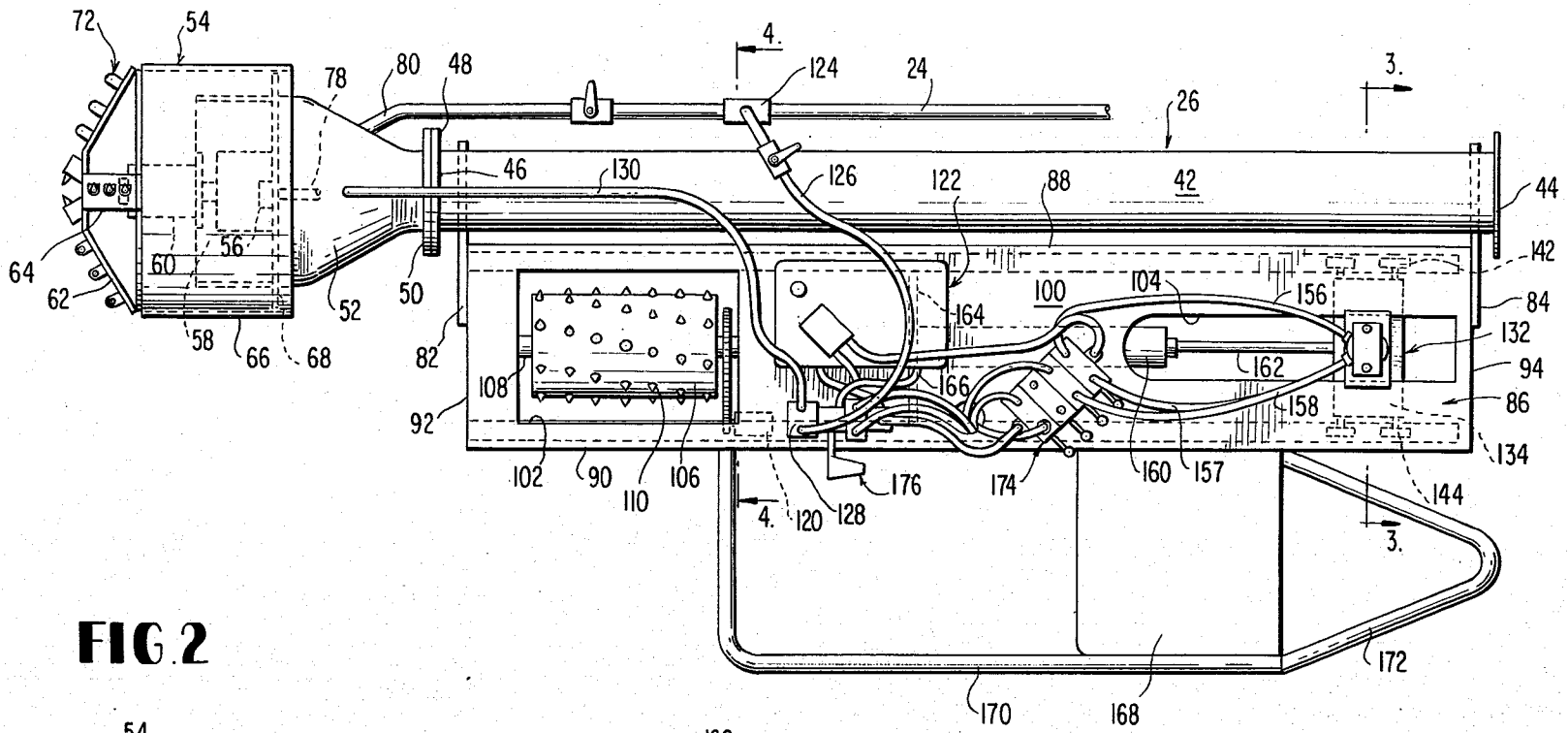
FIG. 1 is a top plan view of the leading apparatus section of a first form of mining apparatus constructed and assembled in accordance with this invention.
Figure 2:
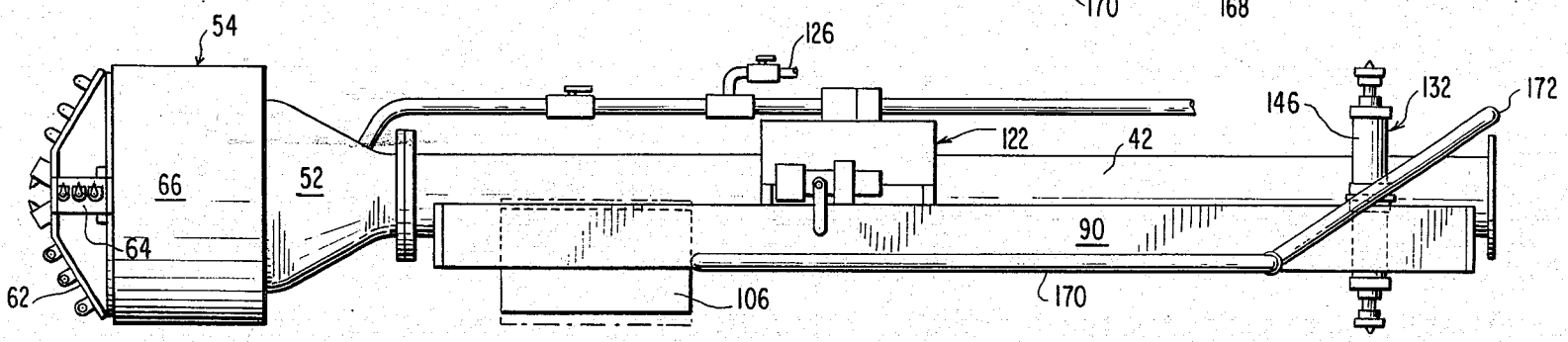
FIG. 2 is a side elevational view of the device shown in FIG. 1.

In the practice of this invention it may be assumed that a seam of material to be mined has been located, and that the seam is of limited height. Typically, in soft coal areas, the shaft height is in the range of 26 inches to 40 inches. In FIGS. 6 through 9 of the drawing a system 20 in accordance with this invention is shown. The system generally comprises a mobile air compressor 22 of conventional construction, having an air supply line 24 extending therefrom. The apparatus includes a leading apparatus section 26 and a telescopically extensible tubular conduit 28. The conduit 28 has an output end 30 which is elevated and evacuates into a cyclone separator 32 also of conventional design. The separator discharges air through an outlet 34 and mined material is fed into a hopper 36 for subsequent transfer to transport vehicles 38.

A typical environment of use is shown in the aforesaid figures, and comprises a shaft 40 formed by the apparatus to follow a seam of coal or the like into a hill-side. This often occurs in strip mining operations in un-level terrain, the seam of coal being, on even ground, approximately parallel to ground level, but becoming too deep for continuation of the strip mining procedure when a hill is reached.

Referring back to FIGS. 1 through 5, the apparatus of this invention is there shown in more complete detail, particularly the leading apparatus section 26. The leading section 26 includes an elongated, tubular initial conduit 42 having a trailing end 44 and an opposite leading end 46. The leading end 46 is affixed, at a flange 48, to a connection flange 50 of an enlarged, bell-shaped intake end section 52. Extending rearwardly from the trailing end 44 of the initial conduit are a series of tubular conduit sections 46 telescopically or otherwise extendible, as the leading section 26 advances in the seam.

A cutter head assembly 54 is operatively mounted on the intake end section 52 of the initial conduit. This includes a stationary mount 56 which extends between the inside walls of the intake end, for an air motor 58. The motor is connected, through a speed reduction mechanism 60, to cross bars 62 and 64 which in turn carry an enlarged drum 66 extending back over the initial portion of the intake end section 52. A fixed wall 68 extends from the end section 52 to close the inside of the drum 66 and prevent passage of mined material thereabout.

Figure 5:
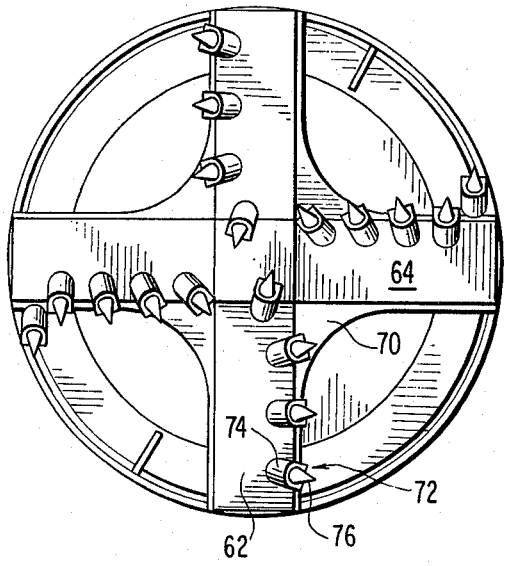
FIG. 5 is a frontal view of the cutter head assembly hereof.

In FIG. 5, it will be observed that the cross bars 62 and 64 have rigidifying webs 70 at their intersections. Mounted on the bars in serpentine array are rows of cutter teeth assemblies 72 including mounting chucks 74 and pointed bits 76. These are slant-mounted toward the direction of rotation of the cutter.

From the above it will be noted that the intake end 58 of the conduit is stationary and that the drum 66 rotates thereabout. The cross bars rotate with the drum. In FIG. 1, it will also be noted that the air motor 58 has an exhaust 78 which is vented into the conduit.

Pressurized air is additionally fed into the conduit 42 via an outlet portion 80 of the air supply line 24 which is vented into the enlarged end section 52 of the conduit. The introduction of a substantial volume of air at this point, coupled with the air motor exhaust, creates a venturi suction at the leading open end of the conduit section 52. Thus, as the cutter head advances in a seam of coal, as described below, the coal is fragmented by the teeth 72 and drawn into the chamber between the drum 66 and the leading portion of the enlarged end section 52 of the conduit. Agitation therein further reduces the size of the fragments, which are then drawn into the conduit 28. At the separator 32, the coal is separated from the air and dropped into the hopper 36.

Forward and aft mounting brackets 82 and 84 are fixedly secured to the conduit section 42. A platform 86 is mounted on these brackets, and includes an inner vertical side plate 88, an outer side plate 90, and front and rear walls 92, 94. Inwardly directed flanges 96, 98 project from the inner and outer side plates respectively. The platform further has a top wall 100 having a forward hatch 102 there-in and also having an elongated slot 104.

Ground contact means for the section 26 comprises a wheel 106 of drum-like form mounted on an axle 108 which extends between mounting plates (not shown) depending from the top wall 100. The wheel has traction spikes 110 thereon. The wheel is mounted substantially parallel to the conduit section 42 and extends upwardly through the hatch 102 of the frame, and below the frame to ground contacts between the flanges 96 and 98. A chain 112 is framed about a drive sprocket 114 secured to the axle 108, and about a sprocket 116 on the output shaft 118 of a reversible hydraulic motor 120. This motor is driven, through a suitable hydraulic circuit, from a main hydraulic pump and reservoir 122 on the platform.

The main pump 122 in turn is powered by the air supply source 22, air being tapped from the line 24 at a fitting 124 and propelled through a hose 126 having a valve assembly 128. Thus, a quantity of air is directed through a hose 130 to power the motor 58 and the remainder is employed for the pump 122.

Figure 3:
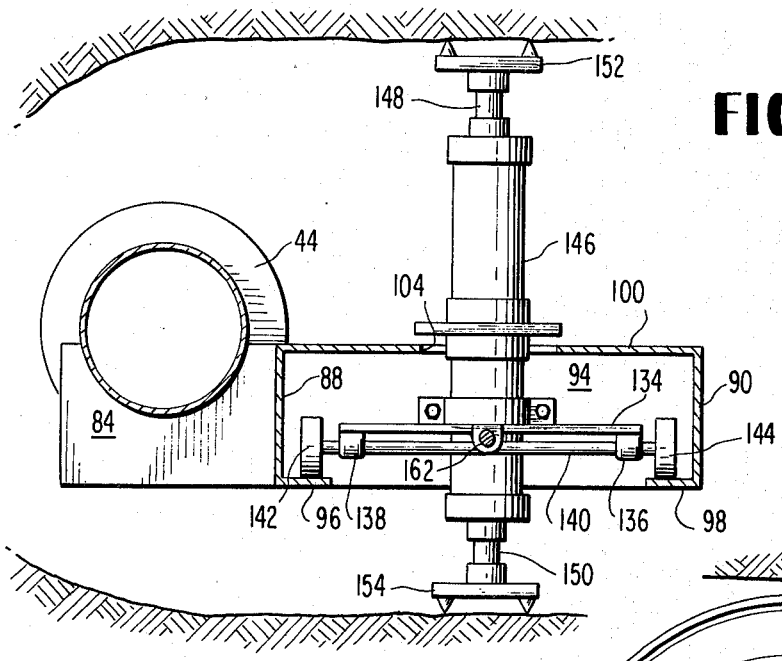
FIG. 3 is a vertical cross-section taken substantially on line 3 — 3 of FIG. 1, looking in the direction of the arrows.
Figure 4:
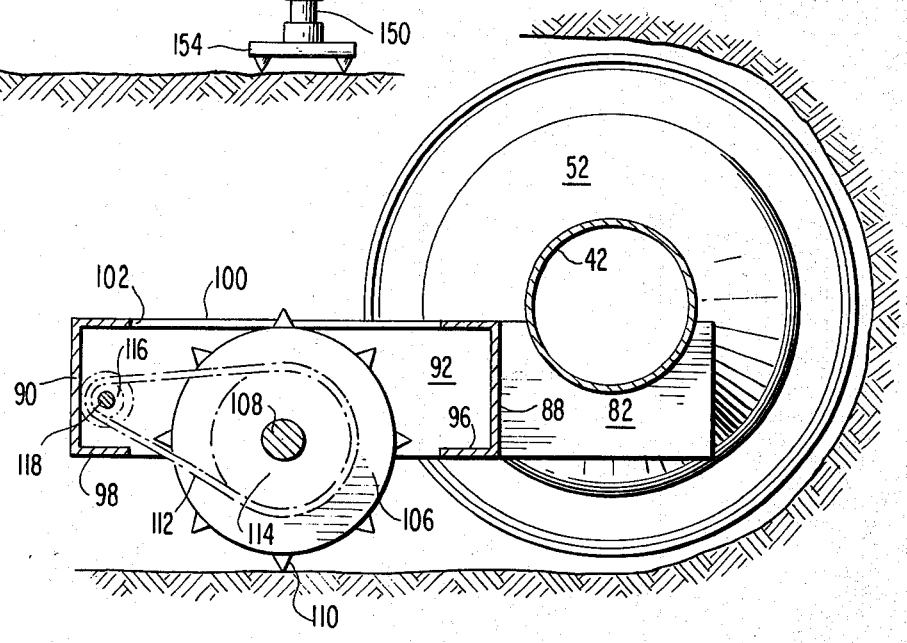
FIG. 4 is another vertical cross-section taken on line 4 — 4 of FIG. 1, looking in the direction of the arrows.

A further important feature of the invention is the provision of extensible and retractable anchoring means 132. The anchoring means comprises a trolley with a cross plate 134 having depending bearings 136, 138 which support a plurality of cross axles 140. Such axles have caster wheels 142, 144 at their ends which are adapted to ride on the flanges 96 and 98. A dual stroke hydraulic cylinder 146, extensible and retractable at both ends, is vertically mounted to extend through the cross plate 134. In FIG. 3, the extension of the cylinder 146 through the slot 104 of the platform is shown. The cylinder has upper and lower extension rods 148, 150, each having a spiked contact disc 152, 154. Upon extension of the rods, these discs engage the floor and roof of the mineshaft. The cylinder 146 is actuated as to extension and retraction by hydraulic lines 156, 157 and 158. Longitudinal movement of the anchoring means is effected by a horizontally mounted hydraulic cylinder 160. The cylinder 160 has a movable rod 162 secured to the trolley at the cross plate 134, and the cylinder is fixedly secured to a plate 164 at its other end. It is actuated through a hydraulic hose 166.

An operator's seat 168 is mounted on a bracket 170 secured to the outer side plate 90 of the platform. The seat has a foldable back portion 172, and is designed to permit the operator to assume a lying back position necessitated by the low clearance of the shaft. At a location on the platform 86 convenient to the operator's seat there is provided a bank 174 of control levers for the hydraulic mechanism. Also near the seat is a foot control lever 176 for the wheel 106 and the motor 58.

FIGS. 11 through 14 of the drawings disclose a modification of the unit, in which a leading conduit section 300 has mounting flanges 302, 304 at its forward and aft ends. A bell form enlarged end 306 is secured by a flange 308, and a rotatable drum 310 is eccentrically mounted thereabout. The drum 310 is carried on a shaft 312 of an air motor 314, and has projecting cross bars 316, 318 on its leading open end. On the cross bars are cutting teeth assemblies 320.

Air is introduced into the motor through a supply line 322 and exhausts into the conduit end 306 by a line 324.

Outwardly and downwardly extending bracket arms 326, 328 and 330, 332 are rotatably secured about the conduit section 300. Extending between the starboard pair of arms 328 and 332 is a longitudinal axle 334. A second longitudinal axle 336 extends between the port side pair of bracket arms 326 and 330. Drum-like wheels 338 and 340 are carried on said axles, and these also have traction spikes 342.

Hydraulic motors 344, 346 are secured on the arms 332 and 330 respectively, and have output shafts 348, 350 with sprockets for drive chains 352, 354. The shafts 334 and 336 also have sprockets about which the chains are operatively engaged, whereby the wheels are selectively rotatable to traverse the unit from side to side.

Stub shafts 356 and 358 extend from ears 360 and 362 on the arms 328 and 326. Hydraulic cylinders 364, 366 are pivotally mounted on these stub shafts, and the cylinders are also pivotally mounted between pairs of ears 368 and 370 on the conduit section 300. Actuation of these cylinders is used to impart a rocking motion to the unit as it is propelled forward in the seam, or to tilt the unit to correctly follow the seam.

The platform in this form of the invention comprises a pair of upper and lower angle bars 372 and 374 fixedly mounted in diametrically opposite positions on the conduit section 300. Top blocks 376 and 378 have V slots therein to ride on the top angle bars 372, and bottom blocks 380, 382 are similarly configured for attachment on the bottom angle bar. A horizontal yoke 384 has an apex portion 386, and arms 388, 390 which are secured to the top block 376, 378 respectively.

Angle bars 392 depend from the yoke to the bottom block thereby establishing a carriage for an extensible and retractable anchor means in the form of a double acting hydraulic cylinder 394. The cylinder 394 has upper and lower rods 396, 398 with spiked foot plates 400, 402. The cylinder extends through an opening 404 in the apex portion 386 of the yoke and is mounted in position relative thereto by a collar 406.

A longitudinal cylinder 408 has an extensible rod 410 secured at a fitting 412 to the block 376 of the yoke. The cylinder has links 414 at its opposite end secured by a cross pin 416 to an upstanding leg 418 on the conduit section 300. With the rod 396, 398 in retracted position, the cylinder is thus movable on the platform in response to actuation of the cylinder 408.

A control bank 420 for the hydraulic means, a control pedal 422 for the air means, and a hydraulic pump 424 similar in function and operation to the first form of the invention in each instance are supplied. An operator's platform 426 is attached to the conduit section 300 by a rail 428. The platform includes a seat 430 and back 432.

Figure 11:
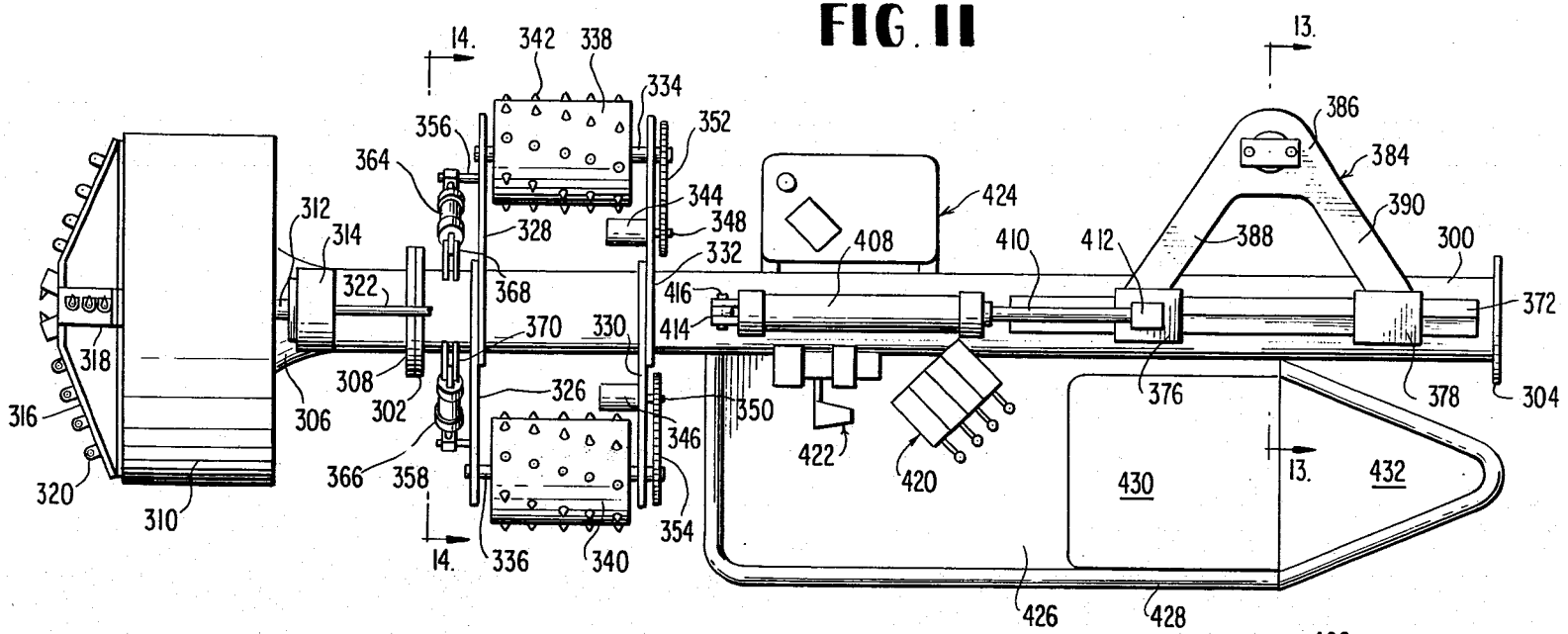
FIG. 11 is a top plan view of a modification of the apparatus.
Figure 12:
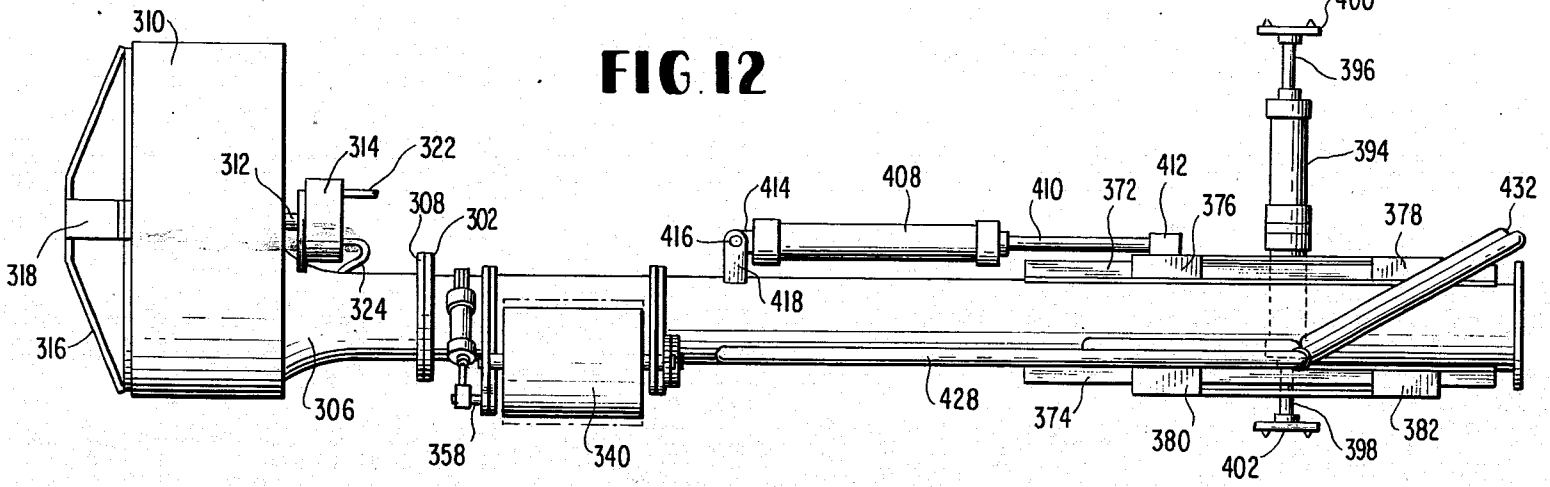
FIG. 12 is a side elevational view of the modified form.
Figures 15, 16, 17:
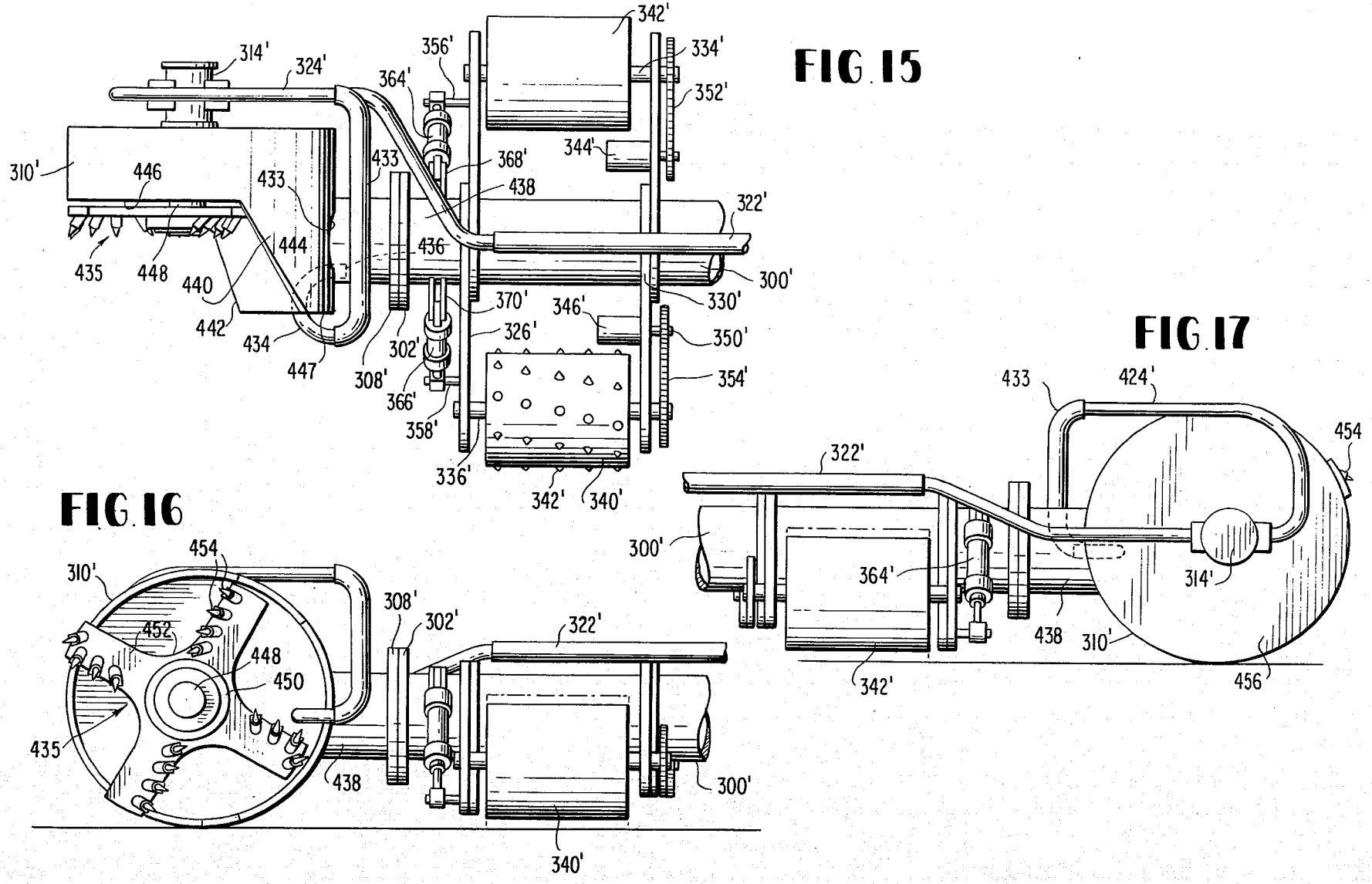
FIG. 15 is a top plan view of a portion of a modified form of the invention.
FIG. 16 is a side elevational view of that portion of the apparatus shown in FIG. 15.
FIG. 17 is a side elevational view of the portion of the apparatus of FIG. 15 from the opposite side to that shown in FIG. 16.

By reference to FIGS. 15, 16 and 17, a modified form of the embodiment shown in FIG. 11 is illustrated, the modification taking place principally in the area of the cutter head assembly. The leading conduit section 300' has coupled thereto at its forward end and at mounting flange 302', a short conduit section 438 by way of flange 308' which terminates at its forward end in a drum 310' forming a part of a cutter head assembly whose axis is at right angles to the axis of conduit section 300' and which is provided with a cylindrical opening 433 within one side which opens to the outer end of conduit section 438. Drum 310' is welded to conduit section 438 such that the interior of the conduit 330' and conduit section 438 are in open communication with the interior of the fixed drum 310'. In contradiction, therefore, to the embodiment of the invention shown in FIG. 11, drum 310' does not rotate. However, it does carry a rotating cutter indicated generally at 435. On the rear wall 456 of the fixed drum 310', an air motor 314' is fixedly mounted and has its output shaft 448 passing through the rear wall 456 of drum 310' and to the end of which is mounted the rotating cutter 435. The cutter 435 consists of cross arms or bars 452 extending from a flange portion 450 which in turn is rotatably fixed to the air motor output shaft 448. Appropriate cutting teeth assemblies 454 are mounted to the arms 452 which correspond to the cross bars of the prior embodiment. Air is introduced into the motor 314 through a supply line 322' and exhausted therefrom by way of line 324', this line being extended by way of line sections 433 and 434 such that the end 436 of the line section 434 projects into the open end of the fixed drum 310' opposite end wall 456 and passes through the leading end of conduit section 438 with the axis of the line section 434 at this point being parallel to the axis of conduit section 438 so as to discharge the exhaust air from motor 314 rearwardly into pneumatic conduit 330'. The effect of this discharge into the vacuum provided by the pneumatic conduit 300' is to achieve, by aspiration as in the other embodiments, the removal of mined material from the area of the cutter 435.

In like manner to the previous embodiments, outwardly and downwardly extending bracket arms 326', 328' and 330', 332', are rotatably secured about the conduit section 300'. Extending between the starboard pair of arms 328' and 332' is a longitudinal axle 334'. A second longitudinal axle 336' extends between the port side pair of bracket arms 326' and 330'. Drumlike wheels 338' and 340' are carried on said axles and these are provided with traction spikes 342' on their outer peripheries. Hydraulic motors 344', 346' are secured on the arms 332' and 330' respectively and have output shafts 348' 350' with sprockets for drive chains 352', 354', as in the prior embodiment. The shafts 334' and 336' also have sprockets about which the chains are operatively engaged such that the wheels are selectively rotatable to traverse the unit from side to side to effect excavation of the material to be mined by lateral shifting of the rotatable cutter 435. The open end of the fixed drum 310' is defined by flat edge portion 446 which is laterally offset from flat edge portion 447 and joined thereto by inclined edge portions 440 and 442. This permits the leading end of the fixed drum 310' to be open such that the cutting teeth assemblies 454 may engage the material to be mined while the rear portion of the drum and in particular the edges 442 and 444 act as scrapers for the rear half of the drum 310' which tends to gather the mined material for transport through the pneumatic conduit section 300'. Otherwise, the nature of control is essentially similar to the prior embodiments, particularly the embodiment of FIG. 11. Obviously, the cutting action is laterally rather than forwardly or inclined relative to the axis of the apparatus, this being the principal difference.

Figure 7:
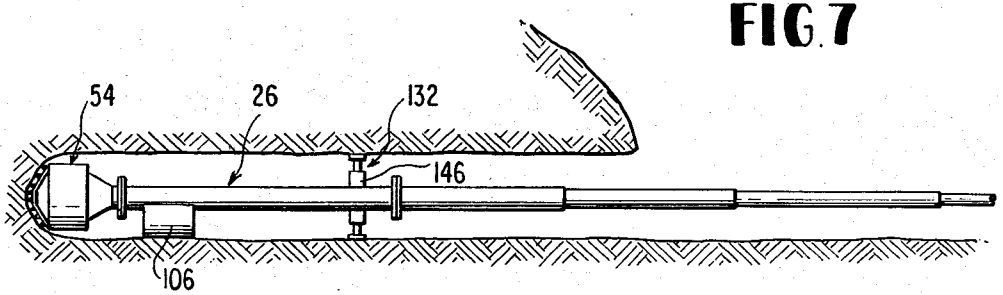
FIGS. 7 through 9 are schematic side views showing a sequence of operations.
Figure 8:
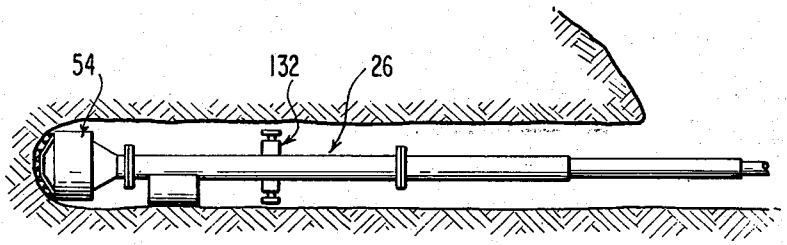
Figure 9:
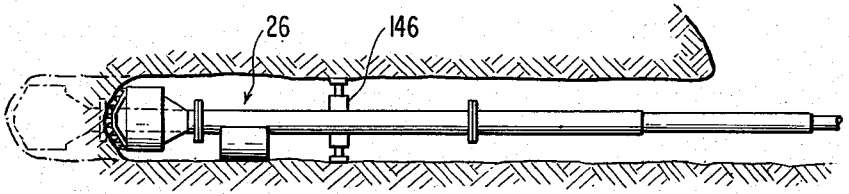
Figure 6:
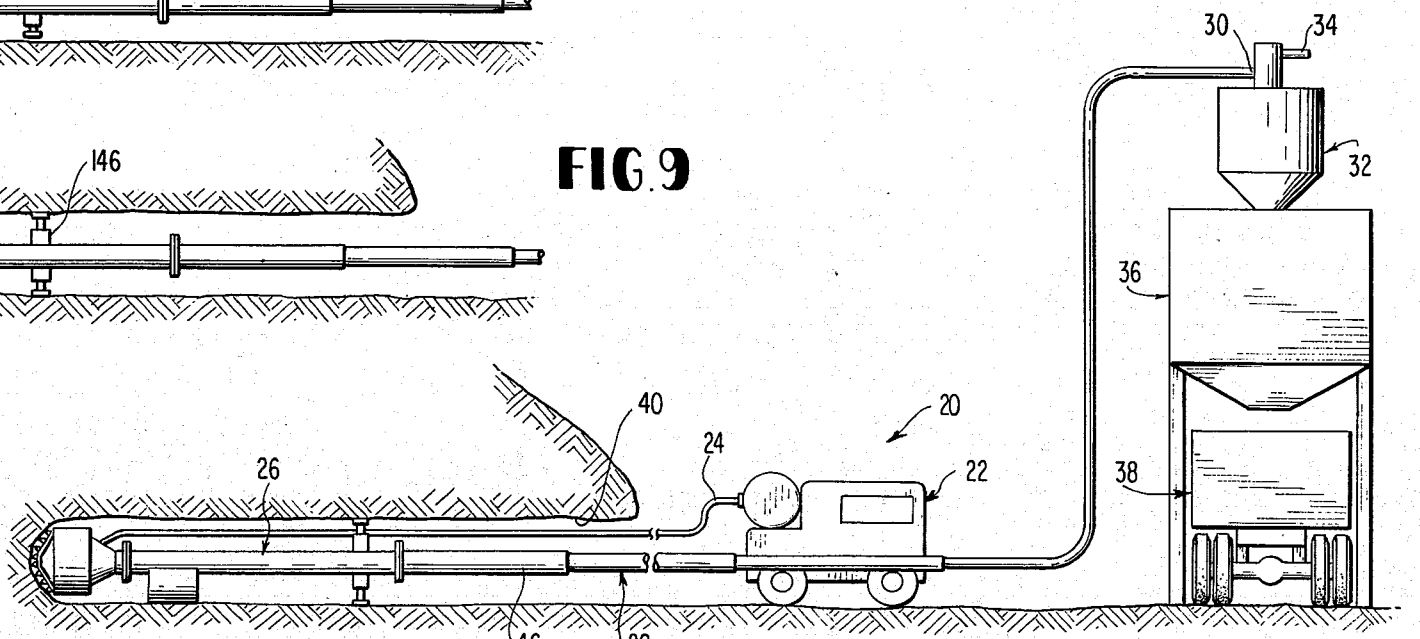
FIG. 6 is a schematic view of an overall assembly hereof.

In each form of the invention, as a seam of coal descends into the ground, it is initially excavated by the apparatus by forcing of the apparatus against the seam to create a mine opening. With this accomplished, as shown in FIG. 7, the unit is put in place with its leading apparatus section within the shaft thus created. Using the form of the invention shown in FIGS. 1 through 5 by way of example, and referring for a description of operation to FIGS. 6 through 10, the unit is anchored in place by extension of the cylinder into contact position as shown in FIGS. 6 and 7. In such initial position, the cylinder 146 occupies a position at the leading end of the slot 104 of the platform through retraction of the rod 162 into the cylinder 160. The cylinder 160 is then placed in neutral position and the excavation procedure begun by back and forth pivoting acts of the leading section 26 through actuation of the wheel 106. This action is shown in FIG. 10. As the initial cut is completed, the operator forces the unit forwardly by extension of the rod 162 from the cylinder 160 thus moving the entire unit forwardly into the seam in gradual steps. The conduit itself is telescopic in nature and follows this forward motion of the unit. When the extreme end of the slot 104 is encountered by the cylinder, the operator retracts the cylinder from contact position and again moves it to the leading end of the slot, whereupon the procedure is repeated.

It will be understood that this sequence of operation is the same for the second described form of the invention.

I claim:

1. In a mining system, mining apparatus comprising:

a leading apparatus section including an initial conduit having an intake end;

an extensible tubular conduit secured to the initial conduit;

means to supply a stream of air under pressure into the initial conduit;

a cutter head assembly on said intake end, said cutter head assembly including: a drum open at one end, means for fluid communicating said drum to said intake end, mounting means for mounting an air motor, an air motor in said mounting means and coupled to said means for supplying said stream of air, said motor including air motor exhaust means for introduction of exhausted air into said conduit, a rotatable cutter operatively mounted to said assembly and coupled to said motor and having a series of leading teeth on the rotatable cutter;

whereby, said air exhaust into said enlarged intake end exhausts mined material from the cutter head assembly into said conduit through said drum;

the leading apparatus section further including platform means secured to the initial conduit;

ground contact means on the platform means to pivot the cutter head assembly and leading apparatus section from side-to-side; and extensible and retractable anchoring means on said platform means mounted for movement relative to the platform means and extendable to an anchoring position and retractable to a transit position.

2. The invention of claim 1, and: said platform having a hydraulic pump thereon driven by air pressure from said means to supply air.

3. The invention of claim 2, and: an operator's seat attached to the platform.

4. The invention of claim 1, wherein: the rotatable drum has a series of cross bars projecting therefrom; and teeth angularly mounted on said cross bars.

5. The invention of claim 1, wherein: said ground contact means comprises a roller wheel rotatably mounted on said platform; and the roller has a series of grip lugs extending therefrom.

6. The invention of claim 5, wherein a pair of said rollers is provided positioned on opposite sides of the conduit.

7. The invention of claim 1, wherein: the platform includes angle bars secured to the initial conduit; and the anchoring means is slidably mounted on the angle bars.

8. The invention of claim 1, wherein said drum is fixed to the end of said conduit intake end and extends generally at right angles thereto and has an opening in one side communicating with said initial conduit, said air motor is fixedly mounted on said drum with the air motor axis coaxial with the drum axis, said drum has an open end facing laterally and carries within that open end said rotatable cutter.

9. The invention of claim 8, wherein the open end of said drum includes laterally offset, forward and rear flat edge portions joined by intermittent edge portions which are inclined relative to the axis of the drum to define a leading drum wall opening permitting cutter contact with the material to be mined.

* * * * *